US008301074B2

(12) United States Patent
Kawachi et al.

(10) Patent No.: US 8,301,074 B2
(45) Date of Patent: Oct. 30, 2012

(54) SHEET CONVEYING APPARATUS WITH AUXILIARY GUIDE WHICH ACCOMMODATES CONVEYANCE MECHANISMS OPERATING AT DIFFERENT RELATIVE SPEEDS

(75) Inventors: Kunihiro Kawachi, Kokubunji (JP); Kyoichi Mizuno, Tama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/279,606

(22) Filed: Oct. 24, 2011

(65) Prior Publication Data

US 2012/0039644 A1 Feb. 16, 2012

Related U.S. Application Data

(62) Division of application No. 12/390,111, filed on Feb. 20, 2009, now abandoned.

(30) Foreign Application Priority Data

Feb. 25, 2008 (JP) ..... 2008-042675

(51) Int. Cl.
*G03G 15/00* (2006.01)

(52) U.S. Cl. ..... 399/406; 399/396

(58) Field of Classification Search ..... 399/406, 399/400, 396, 388; 271/188, 209
See application file for complete search history.

(56) References Cited

U.S. PATENT DOCUMENTS

| | | | | |
|---|---|---|---|---|
| 6,263,186 | B1 | 7/2001 | Okamoto et al. | |
| 6,619,657 | B2 | 9/2003 | Horikoshi et al. | |
| 6,698,752 | B1 * | 3/2004 | Kakuta et al. | 271/188 |
| 2006/0269339 | A1 * | 11/2006 | Okamoto et al. | 399/401 |

FOREIGN PATENT DOCUMENTS

| | | |
|---|---|---|
| JP | 63-68666 | 5/1988 |
| JP | 63-116466 | 7/1988 |
| JP | 03-023150 | 1/1991 |
| JP | 6-156863 | 6/1994 |
| JP | 8-157107 | 6/1996 |
| JP | 2790856 | 8/1998 |
| JP | 11-224012 | 8/1999 |
| JP | 2001-019223 | 1/2001 |

OTHER PUBLICATIONS

Translation of JP 2790856, inventor: Hayakawa et al., published on Aug. 27, 1998.*
Translation of JP 2001-019223, inventor: Agata et al., published on Jan. 23, 2001.*
European Search Report for EP 09 15 2438, dated Aug. 2, 2010.
Japanese Office Action for JP 2008-042675, dated Jan. 12, 2010.
Japanese Office Action for JP 2008-042675, dated Sep. 28, 2010.

* cited by examiner

*Primary Examiner* — Judy Nguyen
*Assistant Examiner* — Blake A Tankersley
(74) *Attorney, Agent, or Firm* — Finnegan, Henderson, Farabow, Garrett & Dunner, L.L.P.

(57) ABSTRACT

A sheet conveying apparatus is provided with a decurling mechanism to correct a curl formed on a sheet; a pair of guides including a first guide member and a second guide member arranged to oppose to the first guide member, the pair of guides constituting a conveyance passage to guide a sheet discharged from the decurling mechanism toward the downstream side in the sheet conveying direction; and an auxiliary guide arranged to protrude obliquely in the sheet conveying direction from the side of the first guide member toward the second guide member to a predetermined position in the conveyance passage.

6 Claims, 7 Drawing Sheets

SHEET CONVEYING APPARATUS WITH AUXILIARY GUIDE WHICH ACCOMMODATES CONVEYANCE MECHANISMS OPERATING AT DIFFERENT RELATIVE SPEEDS

This application is a division of application Ser. No. 12/390,111, filed on Feb. 20, 2009, now abandoned which claims the benefit of priority to Japanese Patent Application No. 2008-042675, filed on Feb. 25, 2008, in Japanese Patent Office, the entire disclosures of which are hereby incorporated by reference.

BACKGROUND OF THE INVENTION

The present invention relates to a sheet conveying smoothly apparatus to convey sheets discharged from a curl correcting device (decurling mechanism) to correct curls formed on the sheets.

In recent years, a wide width nip type fixing device has been widely used. In the fixing device, unfixed sheets are made to pass through a wide width nip formed between a hard roller and a pressing soft roller or between a hard roller and a pressing endless belt suspended around a plurality of rollers. Accordingly, this type fixing device has a tendency to form a large curl on a sheet after fixing. Then, a curl preventing technique has been proposed to employ a decurling mechanism to form an opposite curl to eliminate a deformation (curl) on a sheet caused by a fixing nip at the downstream side of a fixing section or in a sheet conveying apparatus located at the downstream side of a fixing device.

Japanese Patent Unexamined Publication No. 2003-295657 discloses a technique regarding a fixing apparatus in which at the downstream side of a fixing section to form a concave shaped fixing nip between a fixing roller and a fixing belt, a decurling section is arranged so as to form a convex shaped decurling nip between a conveying roller made of a hard material and a pressing roller made of a soft material in the direction reverse to the concave shaped fixing nip.

Japanese Patent Unexamined Publication No. 2006-168940 discloses the following curl correcting technique. As shown in FIG. 1 of this publication, a curl correcting mechanism is arranged between a reversing gate section and a reversing mechanism 56 on a both side print conveyance passage 57 at the downstream side of a fixing device 40. FIG. 2 of the publication shows an outlined structural view of the curl correcting mechanism. In this view, a sheet conveying nip formed between a rigid roller 71 and an elastic roller 72 is made to move around the rigid roller 71 so as to change an entering angle (discharging angle) at which a fixed sheet enters onto the surface of an inclined guide section 77*a* located at the downstream side of the sheet conveying nip, whereby a curl correcting function is controlled for the fixed sheet. Therefore, with the control to switch the entering angle in accordance with the kind of sheets, this curl correcting technique tries to make possible to correct a curl on a fixed sheet properly for various broad kinds of sheets from a thin sheet to a thick sheet without creating a curl in the reverse direction.

When the above-mentioned decurling mechanism was arranged at the downstream side of a fixing nip or a fixing device, a curl correcting function might be made surely. However, in order to realize a compact sheet conveying device, if a guide plate to regulate sheets and conveying rollers to convey sheets were arranged at the downstream side of the decurling mechanism, the following trouble occurred. That is, when the leading edge of a sheet was passing through the conveying rollers, irregular deformation, waving deformation, curl or the like took place on an area of the sheet locating at the upstream side of the decurling mechanism. The situation of the trouble seemed to tend to become more serious toward the trailing edge of the sheet. Further, although a both side printing job had been conducted normally for a while immediately after the job had started, trouble has been caused with the progress of the printing process, and the situation of the trouble has seemed to tend to become more serious gradually. Further, as soon as an elastic roller of the decurling mechanism was replaced with another one, abnormality occurred. Reversely, the situation that the device unexpectedly returned to normal condition was also observed.

Then, as a result of having repeated various tests and examinations, it has turned out that the main cause of the trouble was a mismatch between the sheet conveying speed of the decurling mechanism and that of the conveying rollers. Here, a method might be considered to match the both speeds constantly under various conditions by controlling the driving of the decurling mechanism independently of that of the conveying roller. However, the method caused another problem in the aspects of the compactness of the device and the cost. Therefore, there has been a desire for a sheet conveying apparatus excellent in compactness and capable of preventing trouble such as waving deformation, wrinkles and the like on a sheet.

SUMMARY OF THE INVENTION

The present invention has been made in view of the above problems. An aspect of the present invention is to provide a compact sheet conveying apparatus capable of preventing trouble such as waving deformation, wrinkles and the like on a sheet against a mismatch of the sheet conveying speed of a pair of sheet conveying rollers located at the downstream side for the sheet conveying speed of a decurling mechanism.

The above compact sheet conveying apparatus can be provided with the following structures.

A sheet conveying apparatus, comprises:

a decurling mechanism to correct a curl formed on a sheet;

a pair of guides including a first guide member and a second guide member arranged to oppose to the first guide member, the pair of guides constituting a conveyance passage to guide a sheet discharged from the decurling mechanism toward the downstream side in a sheet conveying direction; and an auxiliary guide arranged to protrude obliquely in the sheet conveying direction from a side of the first guide member toward the second guide member to a predetermined position in the conveyance passage.

EXPLANATION OF SYMBOLS

Figure 1:
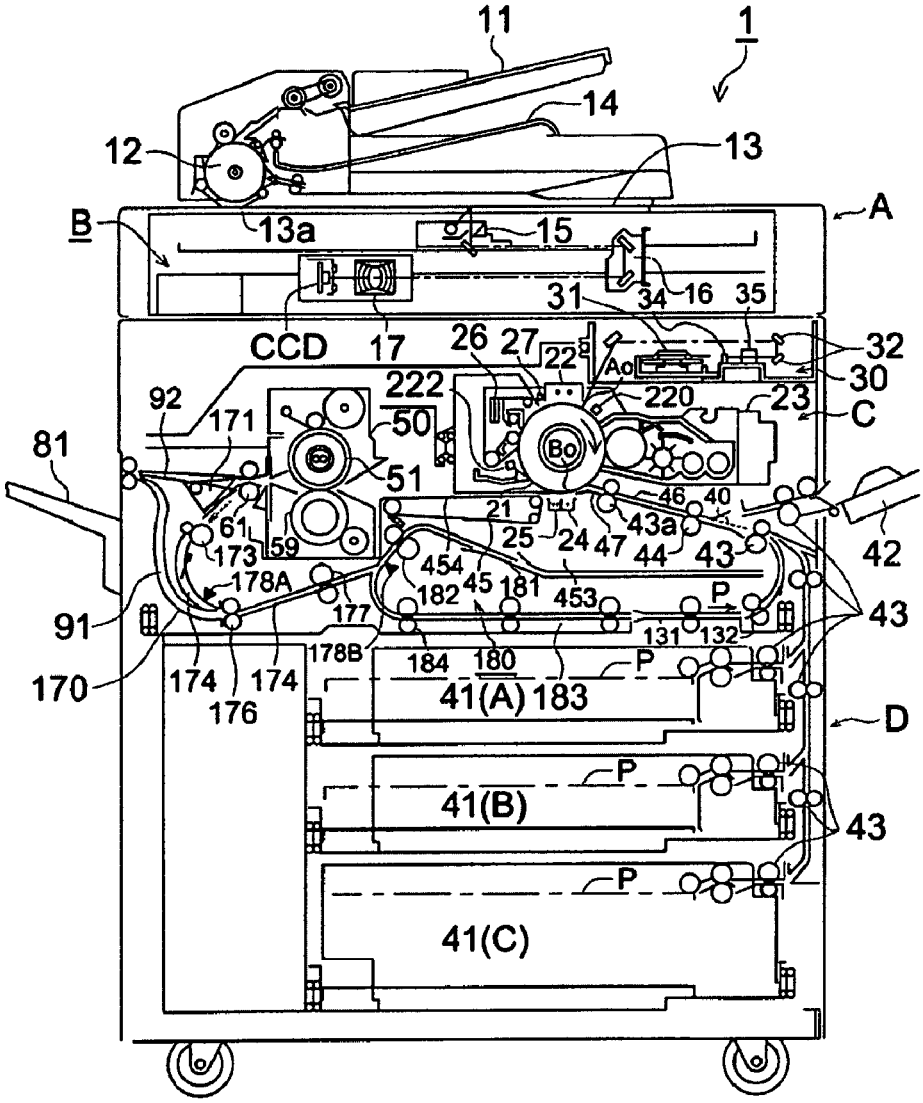
FIG. 1 is a cross sectional structural view of an image forming apparatus usable in the present invention.

1 Image forming apparatus
50 Fixing device
173 Decurling mechanism
173A Rigid roller of the decurling mechanism
173B Elastic roller of the decurling mechanism
174 First passage
174A Inner side guide member
174B Outer side guide member
174C First inner side guide member
174D Second inner side guide member
175, 275 Auxiliary guide
275A Auxiliary guide member
175B, 275B Guide surface
176 Pair of conveying rollers
P Sheet

DETAILED DESCRIPTION OF THE PREFERRED EMBODIMENT

Hereafter, the preferred embodiment of the present invention will be explained. However, the description in this section does not limit the scope of claims and the meaning of technical terms. Further, affirmative explanation in the embodiment of the present invention indicates the best mode and does not limit the technical scope and the meaning of technical terms in the present invention.

An image forming apparatus 1 shown in FIG. 1 is a digital type image forming apparatus and is constituted by an image reading section A, an image processing section B, an image forming section C and a sheet feeding conveying section D to feed and convey a sheet P.

On an upper portion of the image reading section A, there is provided an automatic document conveying mechanism to automatically convey documents. Documents placed on a document stand 11 are separated and conveyed one by one by document conveying rollers 12 to a read-out position 13*a* at where images on a document is read out. The document for which the image read-out has been completed are discharged onto a document discharging tray 14 by the document conveying rollers 12.

Here, images on a document placed on a platen glass 13 are read out by a scanning optical system with the operations that a first mirror unit constituted by an irradiating lamp and a first mirror conducts a read-out action at a speed v and a second mirror unit constituted by a second mirror and a third mirror arranged in the form of V moves in the same direction at a speed v/2.

The read-out images are formed on a light receiving surface of an image taking element CCD being a line sensor through a projecting lens 17. Line-shaped optical images formed on the image taking element CCD are sequentially photo-electrically converted into electric signals (luminance signals), and then the electric signals are subjected to an A/D conversion process to convert them into digital image signals. The thus-produced digital image signals are applied with an image processing process such as a density conversion and a filtering process in the image processing section B. Thereafter, the processed digital image signals are stored once as image data in a memory.

In the image forming section C, there is provided a drum-shaped photoreceptor 21 being an image carrying member. Around the outer periphery of the photoreceptor 21, an electrically charging section 22, an electric potential detecting section 220 to detect the surface electric potential of the charged photoreceptor 21, a developing section 23, a transfer electrode 24 and a separating electrode 25 both acting as a transfer separating section, a cleaning device 26 for the photoreceptor 21, a pre-charge lamp (PCL) 27 being a photo-charge-eliminating section are sequentially arranged in the order of their respective actions. Further, at the downstream side of the developing section 23, there is provided a reflection density detecting section 222 to measure a reflection density of a patch image developed on the photoreceptor 21. The photoreceptor 21 is formed such that a photoconductive compound is coated on a drum-shaped base member, and, for example, an organic photoreceptor (OPC) is preferably used as the photoreceptor 21. As shown in FIG. 1, the photoreceptor is rotated clockwise.

The electrically charging section 22 electrically charges uniformly the surface of the rotating photoreceptor 21. Thereafter, an exposing optical system 30 conducts image exposure for the charged surface of the photoreceptor 21 on the basis of image signals outputted from the memory of the image processing section B. In the exposure optical system 30 acting as the image exposure section being a image writing section, a laser beam is emitted from a laser diode being a light emission source and is guided along a optical passage by a rotating polygonal mirror 31, a fθ lens 34, and a cylindrical lens. Further, the laser beam is reflected a reflecting mirror 32 to bent the optical passage and is used, to conduct main scanning on the surface of the photoreceptor 21. The image exposure section conducts image exposure as the main scanning at the Position of Ao for the photoreceptor 21 and forms a latent image with the rotation of the photoreceptor 21 as the subsidiary scanning. In one example of the present embodiment, exposure is conducted for character portions.

The developing section 23 conducts a reversal development for a latent image on the photoreceptor 21 in such a way that a toner image being a visual image is formed on the surface of the photoreceptor 21. In the sheet feeding conveying section D, sheet feeding units 41(A), 41(B), and 41(C) storing sheets P with respective different sheet size as the sheet storing section and conveying rollers 43 are provided under the image forming unit. Further, a manual sheet feeding unit 42 to conduct a manual sheet feeding is provided at the side. One sheet feeding unit is selected from the sheet feeding units 41(A), 41(B), and 41(C), and a sheet P is fed from the selected sheet feeding unit and conveyed along a conveyance passage 40 by guide rollers 43. Then, the sheet P is stopped temporary by a pair of registration rollers 44 such that the inclination of the sheet P is corrected. Thereafter, the sheet P is conveyed again along the conveyance passage 40 and guided to a transfer position Bo via pre-transfer rollers 43*a*, a sheet feeding passage 46 and a proceeding guide plate 47. At the transfer position Bo, the toner image on the photoreceptor 21 is transferred onto the sheet P by the transfer electrode 24. Then, the sheet P is separated from the surface of the photoreceptor 21 by the separating electrode 25 and loaded on a conveying belt 454 of a conveying belt device 45 with which the sheet p is conveyed to a fixing device 50.

The fixing device 50 comprises a heating roller 51 and a pressing roller 59, and the heating roller 51 is provided with a heat source. Here, the heating roller 51 also acts as a rotating body driving member. The fixing device 50 makes the sheet P to pass through between the heating roller 51 and the pressing roller 59, whereby the toner image on the sheet P is fixed with heat and pressure.

Figure 2:
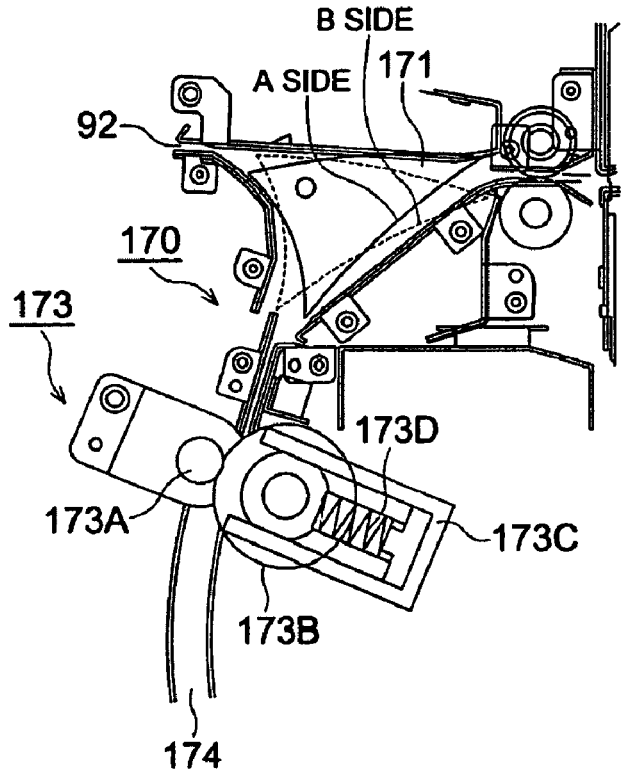
FIG. 2 is a cross sectional structural view of a decurling mechanism according to the present invention.

As shown in FIG. 2, a passage switching gate 171 is shifted to an A-side. Therefore, the sheet P having completed the fixing process for its toner image passes through a passage switching gate 171 and is subjected to a decurl process by a decurling mechanism 173 so that a curl on the sheet P is corrected. Thereafter, the sheet P is conveyed to a discharged sheet reversing section 170. In the discharged sheet reversing section 170, when the back end of the sheet P proceeds just before a pair of first conveying rollers 176 located the most downstream position of the discharged sheet reversing section 170, the sheet p is applied with a switch back operation by the discharged sheet reversing section 170 capable of switching the conveying direction to any one of the normal and reverse direction. After the sheet p has been applied with the switch back operation, the back end of the sheet P up to this time is now made to the leading end, and the sheet is discharged onto a discharged sheet tray 81 via a discharged sheet reversing passage 91. Here, at the upstream position of the pair of first conveying rollers 176, there is provided a first back end detecting sensor 178A to detect the passing timing of the back end of the sheet P. Therefore, the switch back operation to reverse the rotation of a plurality of paired conveying rollers in the discharged sheet reversing section 170 is actuated on the basis of detection signals of the first back end detecting sensor 178A.

Hitherto, the case that an image is formed on one side of a sheet P has been explained.

On the other hand, in another case that images are formed on both sides of a sheet P, a sheet P in which an image has been transferred and fixed onto one side (obverse side) thereof, is conveyed in the arrowed direction of a dotted line as shown in FIG. 1, subsequently subjected to a decurling process to correct a curl thereon by the decurling mechanism, and then guided to a first conveyance passage 174 in the discharged sheet reversing section 170.

Further, the sheet P is conveyed in the downstream direction on the first conveyance passage 174 by the pairs of conveying rollers 176 and 177 and guided to a second conveyance passage 181 in a both side copy reversing section. When the back end of the sheet P reaches right before a pair of conveying rollers 182 located the most upstream position of the second conveyance passage 181, the sheet P is applied with a switch back operation by the pair of conveying rollers 182 capable of switching the conveying direction to any one of the normal and reverse direction. Then, the back end of the sheet P up to this time is now made to the leading end and the sheet P is conveyed into a third conveyance passage 183 for both side copy (duplex copy). Here, at the upstream position of the pair of conveying rollers 182, there is provided a second back end detecting sensor 178B. Therefore, the switch back operation is actuated on the basis of detection signals of the second back end detecting sensor 178B.

The sheet P is shifted into the sheet feeding direction on the third conveyance passage 183 for both side copy by each of conveying rollers 184, subsequently guided to the conveyance passage 40 by the sheet feeding rollers 132, and then fed again toward the transfer position.

As described above, the sheet P is conveyed again toward the photoreceptor 21, and a toner image is transferred onto the reverse side of the sheet P at the transfer position. Then, the sheet P is conveyed again to the fixing device 50 and the toner image is fixed onto the reverse side of the sheet P.

At this time, the passage switching gate 171 is switched to a B-side shown in FIG. 2. Therefore, the sheet P in which images have been fixed on the both sides thereof, passes on a straight discharged sheet passage 92 opened by the switching of the passage switching gate 171 and is discharged onto the discharged sheet tray 81.

FIG. 2 shows an enlarged view of a periphery of the decurling mechanism shown in FIG. 1 and indicates a typical decurling mechanism 173 in detail. The decurling mechanism 173 shown in FIG. 2 is a simple one constituted by a pair of rollers of a rigid roller 173A and an elastic roller 173B. In the decurling mechanism 173, the above pair of rollers applies stress in the form of the nip between them onto an upward convex curl provided on the sheet P by the fixing device 50. Therefore, the shape of the sheet is corrected toward a lower convex curl. As a result, the shape of the sheet is returned to flat.

The outer diameter of the rigid roller 173A is preferably 8 mm and is preferably made of the SUM material having been applied with HNTS treatment. The axis of the rigid roller 173A is supported by a fixed bearing.

The outer diameter of the elastic roller 173B is preferably 24 mm and is preferably one in which a cored bar having an outer diameter of 8 mm is covered with a foamed silicone rubber whose Asker C hardness is 8° to 18°. The elastic roller 173B is supported by a bearing which is supported to be slidable in a groove on a flame 173C and a spring 173D biases the bearing so as to press the elastic roller 173B toward the rigid roller 173A.

With the biasing force of the spring, the soft elastic roller 173B bites deeply the small diameter rigid roller so that a strong nip in the form of lower convex is formed between them.

Since the degree of correction of the above low convex curl is regulated by the curvature of the lower convex form and the width of the nip, the distance between the axis of the rigid roller 173A and the axis of the elastic roller 173B is made constant.

The rigid roller 173A is driven by a driving section linked therewith so as to rotate actively. On the other hand, the elastic roller 173B is rotated with the follow motion by receiving friction force from the surface of the rigid roller 173A.

Figure 4:
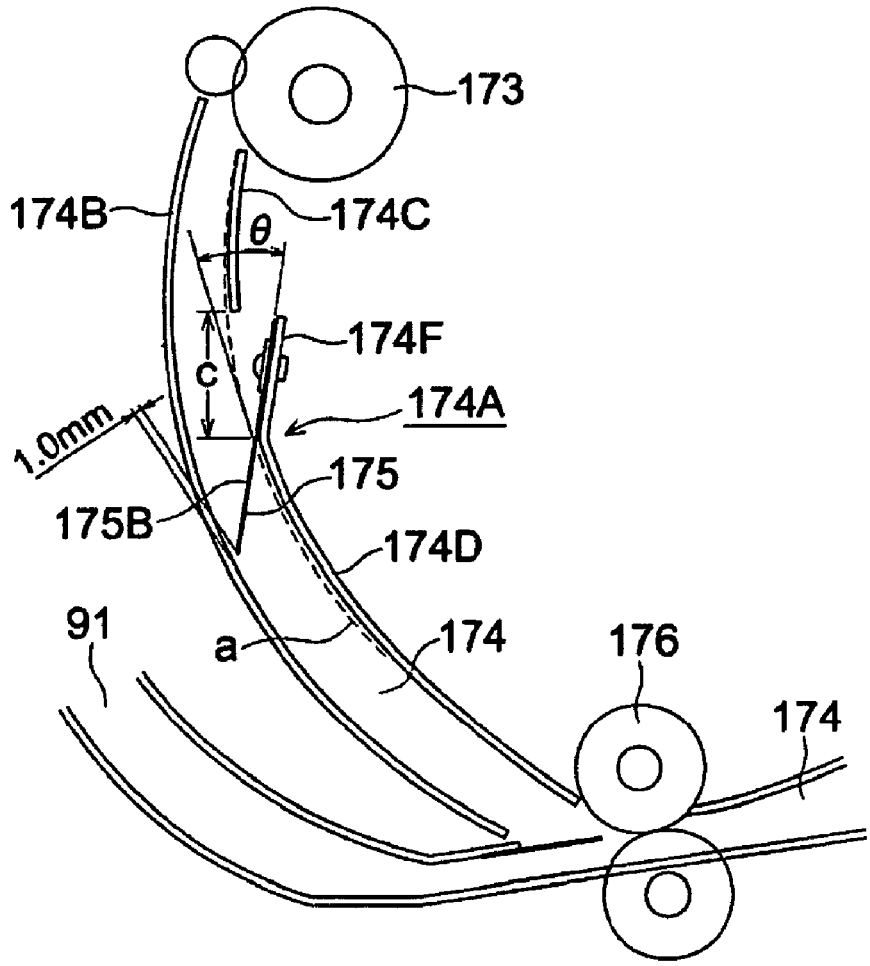
FIG. 4 is a cross sectional structural view of a discharged sheet reversing section usable in the present invention in the first embodiment.

The first embodiment of the present invention is explained with reference to FIG. 4 which shows an enlarged View of the first conveyance passage 174 of the discharged sheet reversing section 170 according to the present invention.

The first conveyance passage 174 of the discharged sheet reversing section 170 is shaped in a curved passage, and the first conveyance passage 174 is constituted by an inner side guide member 174A to guide a sheet at the inside of the curved passage and an outer side guide member 174B to guide a sheet at the outside of the curved passage. Further, the inner side guide member 174A is constituted by a first inner side guide member 174C located at the upstream side and a second inner side guide member 174D located at the downstream side. The first inner side guide member 174C and the second inner side guide member 174D are separated by a distance "c" and are supported on the discharged sheet reversing section 170 in such a way that the surfaces of both of the first inner side guide member 174C and the second inner side guide member 174D are located on a common line "a". At the most upstream portion of the second inner side guide member 174D, there is provide a face section 174F which protrudes toward the reverse surface side to form an inclination with an angle θ to the above common line "a", and the face section 174F is extended in a direction along the width of a sheet with a width corresponding to the allover width of a sheet. One end of an auxiliary guide 175 is fixed to the face section 174F. The second inner guide member 174D is adapted to support the auxiliary guide 175 in such a way that the tip end of the auxiliary guide 175 is extended to approach close about 1 mm to the outer guide member 1748.

The auxiliary guide 175 is a sheet member made of PET (polyethylene terephthalate), and its tip end is applied with a polishing treatment and its other end opposite to the tip end is provided with an adhesive potion. With this adhesive portion, the auxiliary guide 175 is adhered to the face section 174F of the second inner guide member 174D by an adhesive. The thickness of the auxiliary guide 175 is preferably 0.1 mm. The auxiliary guide is extended to whole area in the direction along the shiftable width of a sheet. However, the present invention is not limited to this embodiment. A plurality of narrow width auxiliary guides 175 may be separately arranged side by side at plural positions in the direction along the shiftable width of a sheet.

In the above embodiment, the operations are conducted most effectively under the following conditions.

It is supposed that the sheet conveying speed of the decurling mechanism 173 is Vd and the sheet conveying speed of the pair of conveying rollers 176 is Vt.

Even if the envisaged variation ranges of the above sheet conveying speeds Vd and Vt are taken into account, it is assumed that the relationship of (Vt>Vd) is always maintained.

Figure 5:
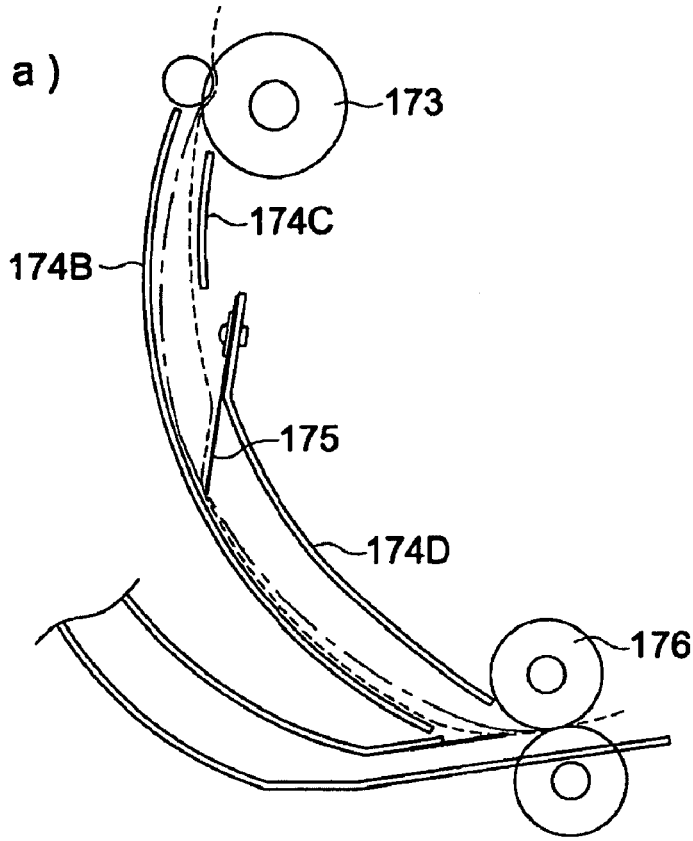
FIG. 5 is a conceptual diagram showing a behavior of a sheet in the discharged sheet reversing section usable in the present invention.
Figure 5:
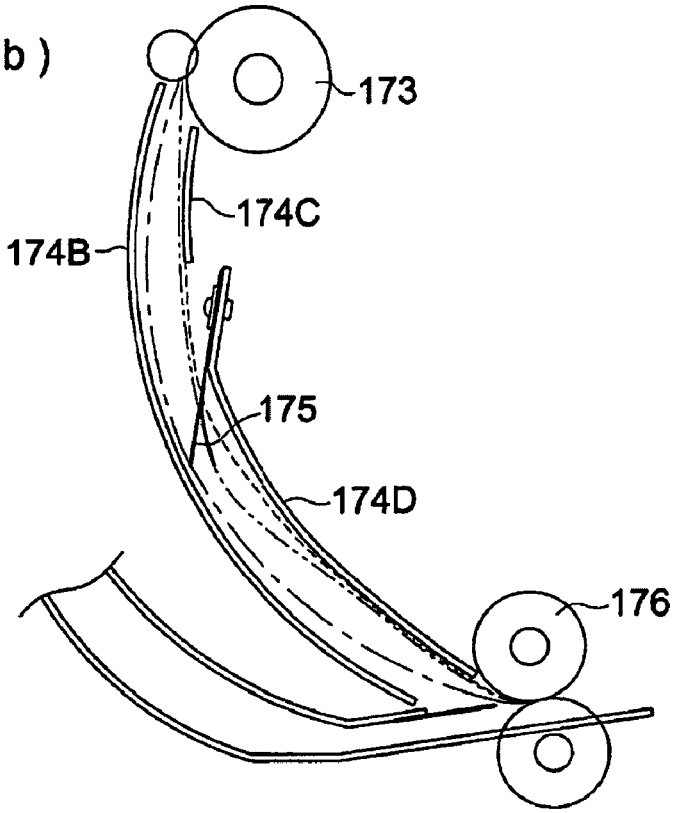

FIG. 5 is an illustration showing the behavior of a sheet P in the first conveyance passage 174 in the discharged sheet reversing section 170 in the above embodiment, where the sheet P has been already applied with the fixing process and the relationship of (Vt>Vd) is maintained.

FIG. 5(*a*) is a conceptual diagram showing the trajectory of the leading end of a sheet P from the time of being discharged from the decurling mechanism 173 to the time of arriving the pair of conveying rollers 176. Namely, the dotted line shows the trajectory of the leading end during the period that the leading end of the sheet P moves along the surface of the first inner side guide member 174C, is guided along the inclined guide surface of the auxiliary guide 175, moves while approaching to or coming in contact with the outer side guide member 174B and arrives to the nip between the pair of conveying rollers 176.

Further, a one dot chain line shows the attitude of the sheet P at the time when the leading end of the sheet P has arrived at the pair of conveying rollers 176. Even if the sheet P moves on the various trajectories between the dotted line and the one dot chain line, the sheet P arrives to the pair of conveying rollers 176 while being regulated as shown with the one dot chain line by the action of the auxiliary guide 175.

FIG. 5(*b*) is a conceptual diagram showing the attitude of a sheet P right before the back end of the sheet P goes out of the decurling mechanism and the condition that the guide surface 175B of the auxiliary guide 175 deforms due to the deformation of the auxiliary guide 175.

As stated above, since there is the relationship of (Vt>Vd) at this time, the length of a sheet P being held between the decurling mechanism 173 and the pair of conveying rollers 176 at the time when the leading end of the sheet P has arrived at the pair of conveying rollers 176, is gradually reduced as the sheet P is proceeding, and the length becomes the shortest at the time right before the back end of the sheet p escapes from the decurling mechanism. The attitude of the sheet P at the time when the back end of the sheet P has been held by the pair of conveying rollers 176, is shown with a one dot chain line. The attitude of the sheet P at the time right before the back end of the sheet P escapes from the decurling mechanism, is shown with a two dot chain line. Here, the difference (Vt−Vd) between the sheet conveying speed Vt of the pair of conveying rollers 176 and the sheet conveying speed Vd of the decurling mechanism may be regulated by the dispersion in processing, working temperature and deterioration of main machinery components. Therefore, the attitude of the sheet P shown with the two dot chain line may change variously. The difference (Vt−Vd) has a predetermined critical value. If the difference (Vt−Vd) becomes larger than the critical value, wrinkles newly take place on the sheet P on which a curl caused by the fixing process has been corrected by the decurling mechanism 173. The attitude of a sheet P being in the critical condition is shown a dotted line.

Therefore, it may be important that the attitude of a sheet P is made not to become the one shown with the dotted line for the envisaged change range of the difference (Vt−Vd). For example, if the gap distance between the outer side guide member 174B and the inner side guide member 174A and 174D, the length of the guide surface 175B of the auxiliary guide 175, the design specification such as arrangement are set properly, the setting of the attitude may be made easily.

With the application of the above embodiment to the first conveyance passage, a sheet P on which a curl has been eliminated by the decurling mechanism 173 is conveyed by a pair of conveying rollers without newly causing wrinkles, waving deformation and the like, and the sheet P is applied with a switch back operation and discharged onto the discharged sheet tray 81 via the discharged sheet reversing passage 91.

Figure 6:
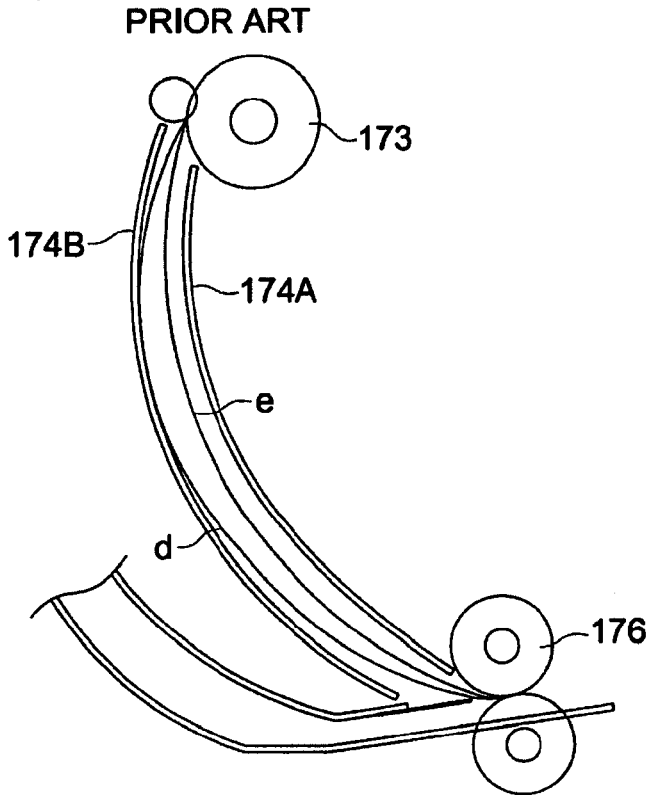
FIG. 6 is a conceptual diagram showing a behavior of a sheet in a conventional discharged sheet reversing section being not usable in the present invention.
Figure 6:
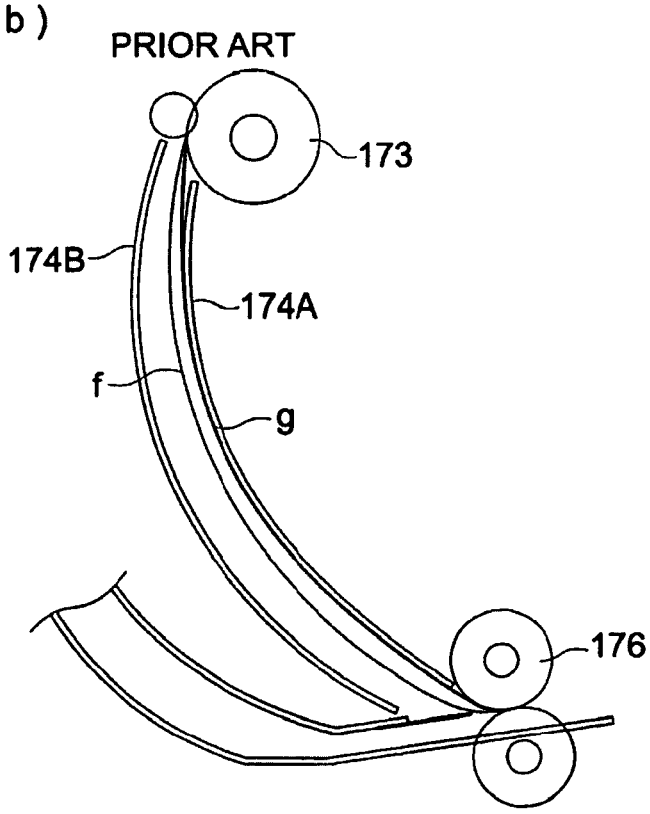

As shown in FIGS. 6(*a*) and 6(*b*), in the first conveyance passage 174 according to prior art, there is not provided an auxiliary guide, and an inner side guide member 174A and an outer side guide member 1743 are arranged and fixed so as to structure a curved passage.

FIG. 6(*a*) shows the behavior of a sheet in the case that the leading end of a fixed sheet P moves along the outer side guide member 1743 to the pair of sheet conveying rollers 176. The attitude of the sheet P at the time that the leading end of the sheet P arrives at the pair of sheet conveying rollers 176 becomes as shown with a line of "d", and the attitude of the sheet P at the time that the back end of the sheet P escapes from the decurling mechanism becomes as shown with a line of "e". Therefore, the sheet in which a curl has been eliminated by the decurling mechanism 173 may be conveyed smoothly without newly causing wrinkles. However, the behavior of a sheet in the case that the leading end of a sheet P moves along the inner side guide member 174A becomes as shown in FIG. 6(*b*). That is, the attitude of the sheet P at the time that the leading end of the sheet P arrives at the pair of sheet conveying rollers 176 becomes as shown with a line of "f", and the attitude of the sheet P at the time that the back end of the sheet P escapes from the decurling mechanism becomes as shown with a line of "g". On the condition shown with the line of "g", since the stress almost equal to the frictional conveyance force of the pair of conveying rollers 176 works on the sheet P, wrinkles are newly generated on the sheet P in which a curl has been eliminated by the decurling mechanism 173.

On the other hand, in the case that Vt is smaller than Vd, when the leading end of the sheet P moves along the outer side guide member 174B, the attitude of the sheet P becomes as shown with a line of "d" in FIG. 6(*a*). Since the sheet conveying speed of the decurling mechanism is faster, the loop of the sheet P becomes gradually larger and arrives to the outer side guide member 174B and then waving deformation takes place on the sheet with the elapse of time. Further, the condition of the waving deformation becomes gradually serious until the back end of the sheet P escapes from the decurling mechanism.

In the above-mentioned embodiment of the present invention, with the structure that an auxiliary guide is provided on the first conveyance passage, it becomes possible to solve the problems that the waving deformation and wrinkles are newly generated on the sheet P having been subjected to the decurling process due to the mismatch between the sheet conveying speed of the decurling mechanism and the sheet conveying speed of the pair of conveying rollers. In addition, it becomes possible to provide a compact conveying device without necessitating complicate mechanisms for drive speed controls.

Figure 7:
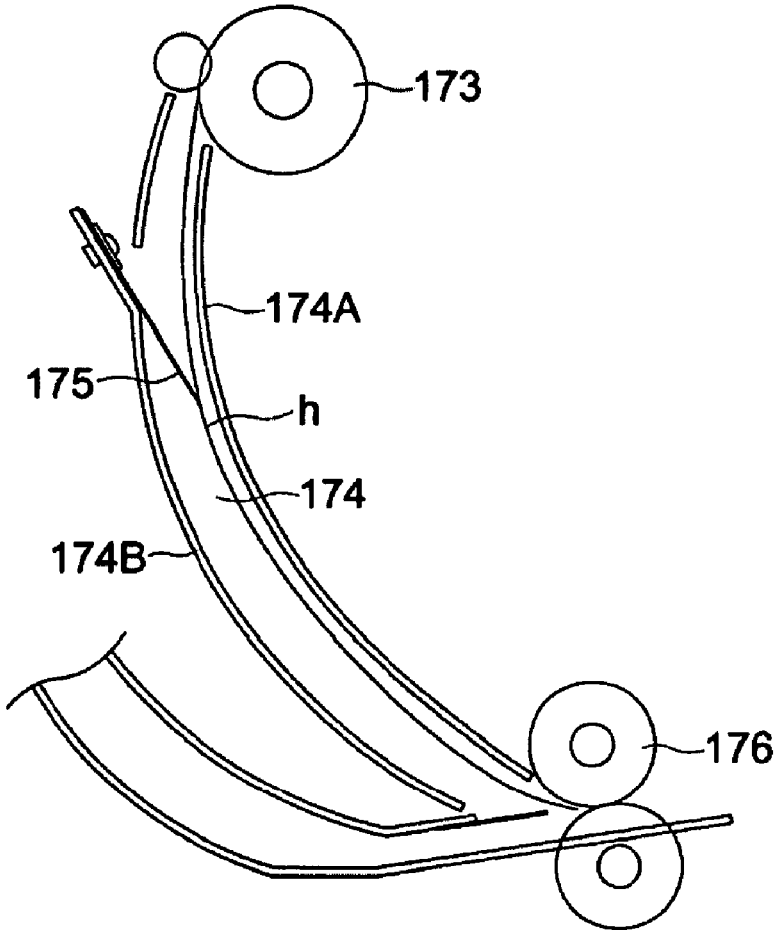
FIG. 7 is a cross sectional structural view of a discharged sheet reversing section usable in the present invention in the second embodiment.

FIG. 7 shows a specific diagram showing the second embodiment as being another embodiment of the present invention. In this embodiment, as the matters different from the first embodiment, an auxiliary guide 175 is provided on the outer side guide member 174B such that the auxiliary guide 175 protrudes from the side of the outer side guide member 174 toward the inner side guide member 174A with an inclination angle and the tip end of the auxiliary guide 175 is located to be spaced about 1 mm from the inner side guide member 174A.

With the guide by the auxiliary guide 175, the tip end of a sheet P which may be discharged in various directions from the decurling mechanism 173 passes through the gap formed between the tip end of the auxiliary guide 175 and the inner side guide member, moves along the surface of the inner side guide member 174A, and arrives to the pair of conveying rollers 176.

In the above embodiment, the operation is conducted the most effectively under the following conditions.

Even with the consideration for the possible variable range of the conveying speeds of Vt and Vd, it is assumed that the relationship of (Vt<Vd) is always maintained.

The attitude of the sheet P at the time that the leading end of the sheet P enters in the pair of conveying rollers 176 becomes as shown with a line of "h" in FIG. 7. Thereafter, with the relationship of (Vt<Vd), the sheet P is conveyed in such a way that the attitude of the sheet P makes a loop gradually larger while maintaining a circular arc toward the outer side guide member 174B. The guide surface 175B of the auxiliary guide 175 displaces so as to allow the loop to become larger. In the above embodiment, the displacement of the guide surface 175B of the auxiliary guide 175 can be realized by the elastic deformation of the PET sheet itself.

The third embodiment is an embodiment employing the both of the first embodiment and the second embodiment. A plurality of auxiliary guides are arranged in the conveyance passage at the inner side of the outer side guide member 174B and at the inner side of the inner side guide member 174A so as to oppose to each other. The plurality of auxiliary guides collects the sheet P at a central area in the gap between the outer side guide member 174B and the inner side guide member 174A and guides the sheet P along the passage at the central area. The attitude of the sheet P at the time that the leading end of the sheet P arrives at the pair of conveying rollers 176 occupies the passage almost on a common line to connect a discharging point of the decurling mechanism to discharge the sheet P, the above central area and a nip point of the pair of conveying rollers 176. Therefore, this embodiment has an advantage capable of dealing with the both cases of the relationship of (Vt>Vd) and the relationship of (Vt<Vd).

Figure 8:
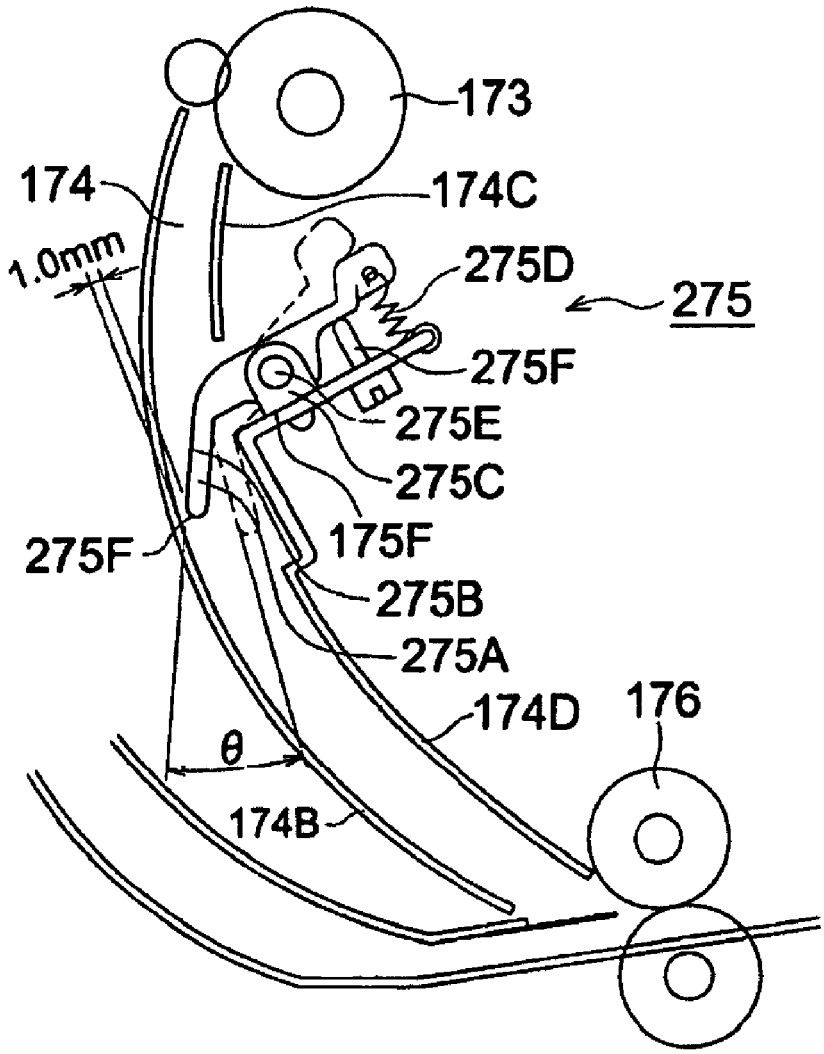
FIG. 8 is a cross sectional structural view of an auxiliary guide usable in the present invention in the fourth embodiment.

FIG. 8 shows a schematic diagram of the fourth embodiment being another embodiment of the present invention. The auxiliary guide 245 is constituted by an auxiliary guide member 275A produced by the molding of polycarbonate resin, ABS (acrylonitrile butadiene styrene) resin and the like, a bearing 275C to support the auxiliary guide member 275A rotatably, and a spring 275D to rotate the auxiliary guide member 275A in the direction to make it approach to the outer side guide member 174B. The bearing 275C is fixed to a face section 174F of the inner side guide member 174A. The auxiliary guide member 275 is supported rotatably by the bearing 275C. The auxiliary guide member 275 includes a guide surface 275B to guide the sheet P from the first inner side guide member 174C to the outer side guide member 174B and protrusions 275E to engage with the above bearing 275C on its both sides. Further, the auxiliary guide member 275 has a regulating section 275F on the inner side guide member 174A so as to allow the guide surface 2758 of the auxiliary guide member 275A to displace from the surface of the second inner side guide member 174D within a range of an angle of θ. The auxiliary guide member 275A is rotated by the spring 275D and the rotation is stopped when the guide surface 275B displaces to the position defined with the angle of θ. The terminal end of the guide surface B, that is, the tip end section 275C of the auxiliary guide member 275A is set at the position separated by about 1 mm from the outer side guide member 1748.

In the fourth embodiment, the auxiliary guide 175 in the first embodiment is replaced with the auxiliary guide 275. Therefore, the effect and the applicable range of Vd and Vt are the same in the first embodiment.

Therefore, the auxiliary guide 275 in the fourth embodiment can be replaced with the auxiliary guide 175 in the second and third embodiments and provides almost the same effects.

Figure 3:
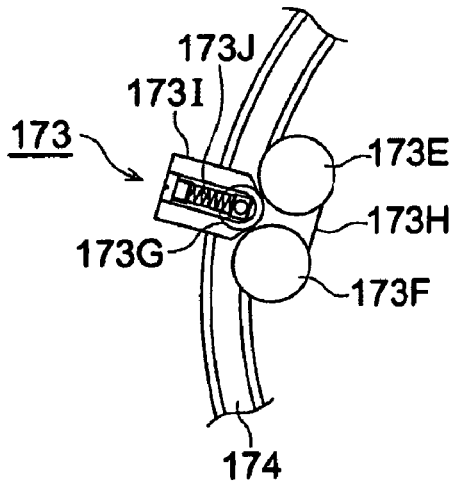
FIG. 3 is a cross sectional structural view of another decurling mechanism according to the present invention.

The above-mentioned invention can be effectively applied to other decurling mechanisms. FIG. 3 shows a decurling mechanism according to another embodiment different from that shown in FIG. 2. In this decurling mechanism, a roller 173G is pressed onto a central portion of an endless belt 173H stretched around two rollers 173E and 173F and a curl on a sheet is corrected by the shape of the nip between the roller 173G and the endless belt 173H. The rotation bearing of the roller 173G is arranged to slide in a groove of a flame 173I with the aid of a spring 173J so as to press the endless belt 173H. As same as the decurling mechanism, one of the two rollers 173E and 173F is liked with a driving section and is driven by the driving section.

According to the present invention, it is possible to provide a sheet conveying apparatus capable of eliminating a waving deformation or a curl on a sheet caused by a speed difference between the sheet conveying speed of a decurling mechanism to correct a curl on a sheet formed by a fixing nip section and the sheet conveying speed of a pair of conveying rollers located at the downstream side of the decurling mechanism.

What is claimed is:

1. A sheet conveying apparatus, comprising:

a decurling mechanism to correct a curl formed on a sheet and including a pair of decurling rollers to convey the decurled sheet while pinching the decurled sheet therebetween;

a pair of guides including a first guide member and a second guide member arranged to oppose to the first guide member, the pair of guides constituting a conveyance passage to guide the decurled sheet being conveyed by the pair of decurling rollers toward a downstream side in a sheet conveying direction, wherein the conveyance passage is shaped in a curved conveyance passage, and wherein the first guide member is located at the inner side of the curved conveyance passage, and the second guide member is located at the outer side of the curved conveyance passage;

a pair of conveying rollers disposed at the downstream side of the pair of guides and to convey the decurled sheet while pinching the decurled sheet therebetween, wherein the conveyance passage constituted by the pair of guides has a length to allow the decurled sheet to be pinched simultaneously by both the pair of decurling rollers and the pair of conveying rollers; and an auxiliary guide arranged to protrude obliquely in the sheet conveying direction from a side of the second guide member toward the first guide member to a predetermined position located close to the first guide member such that the decurled sheet being conveyed by the pair of decurling rollers is guided along the first guide member toward the pair of conveying rollers by the auxiliary guide, and the decurled sheet being conveyed while being pinched both the pair of decurling rollers and the pair of conveying rollers is prevented by the auxiliary guide from being in contact with the second guide member, wherein the auxiliary guide includes a sheet-shaped elastic member and is adapted to displace from the predetermined position toward the second guide member by deformation of the sheet-shaped elastic member in response to an acting force received from the sheet.

2. An image forming apparatus, comprising:

an image forming device to form an image on a sheet; and the sheet conveying apparatus described in claim 1 and to convey the sheet on which an image is formed by the image forming device.

3. The image forming apparatus described in claim 2, wherein the image forming device includes a fixing section to fix an unfixed toner image on a sheet and the sheet conveying apparatus is located at a downstream side of the fixing section in the sheet conveying direction.

4. The image forming apparatus described in claim 2, further comprising a discharged sheet reversing section to reverse an obverse side of a sheet to a the reverse side; and the sheet conveying apparatus is provided to convey the decurled sheet to the discharged sheet reversing section.

5. The sheet conveying apparatus described in claim 1, wherein the pair of decurling rollers has a sheet conveying speed faster than that of the pair conveying rollers.

6. The sheet conveying apparatus described in claim 1, wherein a distance between the predetermined position and the first guide member is about 1 mm.

* * * * *